United States Patent [19]

Lancella

[11] Patent Number: 4,840,587

[45] Date of Patent: Jun. 20, 1989

[54] COMPOSITE FEMALE CONTACT

[75] Inventor: Attilio Lancella, Genova-Sestri, Italy

[73] Assignee: CONNEI S.p.A., Italy

[21] Appl. No.: 164,892

[22] Filed: Mar. 7, 1988

[30] Foreign Application Priority Data

Mar. 25, 1987 [IT] Italy ..... 12446 A/87

[51] Int. Cl.[4] ..... H01R 13/54

[52] U.S. Cl. ..... 439/851

[58] Field of Search ..... 439/851

[56] References Cited

U.S. PATENT DOCUMENTS 4,447,108 5/1984 Ghigliotte et al. .

FOREIGN PATENT DOCUMENTS 811272 4/1937 France ..... 439/851

*Primary Examiner*—Joseph H. McGlynn

*Attorney, Agent, or Firm*—Larson and Taylor

[57] ABSTRACT

The composite female contact (1, 4) adapted to receive a pin contact (6), is of the type in which, when the pin contact is not inserted, the areas intended to establish the electric contact with the pin contact upon insertion of same are arranged at least approximately according to a family of straight generatrices of a hyperboloid of revolution of one branch. The composite female contact comprises a proper elastic contact element consisting of a cylindrical sleeve (1) made of any suitable metal or metal alloy, provided with through slots (2) arranged on its cylindrical surface and inclined with respect to the longitudinal axis of said sleeve, said sleeve being subjected to permanent deformation by twisting according to a predetermined angle and directed in the sense of inclination of the slots. The composite female contact further comprises a housing body (4) made of any suitable metal or metal alloy and presenting a cavity (104) apt to house in a stable manner the elastic contact element (1), for its electric connection with any type of circuit.

4 Claims, 2 Drawing Sheets

COMPOSITE FEMALE CONTACT

BACKGROUND AND SUMMARY OF THE INVENTION

Object of the present invention is a female contact, adapted to receive a male contact of the pin type in which when the pin is not inserted the areas intended to establish the electric contact with the pin, upon insertion of same, are arranged at least approximately according to a family of straight generatrices of a hyperboloid of revolution of one branch.

A contact of such type is known for example from U.S. Pat. No. 4,447,108 in the name of the same inventor: said contact is constructed in a single piece, made of any suitable conductive metal or metal alloy, for example a brass alloy used in components for electric conduction. Said type of contact, although satisfactory, can in some cases present some disadvantages, and precisely:

In the case that, following to particular standard rules or functional requirements, the contact must bear, while maintaining unaltered its characteristic features of elasticity and electric conductivity, high temperatures and repeated mechanical stresses (depending upon the insertion and removal performed a plurality of times of the male pin contact), it is desirable to construct the said contact by using particular metals or metal alloys (such as for example a copper-beryllium alloy). In such a case however there arises the problem relating to the parts of the contact which are not intended to receive the pin contact, such as for example the appendices for the connection with the electric circuits, for which it is required that there be maintained the features of plastic deformability proper to brass or similar alloys and which instead are not possessed by harder metals or alloys (such as for example the above indicated copper-beryllium alloy);

In the more general case in which due to particular requirements of electric conductivity, chemical or thermic resistance, the portion contacting the pin contact must be made of expensive metals or metal alloys, it is evident that the construction of the whole contact in said metal or metal alloy leads necessarily to a remarkable increase of the cost of the contact itself.

In order to avoid such inconveniences, the invention contemplates a female contact of the above described type, characterized by the fact of being composite, i.e. of comprising:

a proper elastic contact element (intended to receive the pin contact) consisting of a cylindrical sleeve made of any suitable metal or metal alloy, provided with through slots arranged on its cylindrical surface and inclined with respect to the longitudinal axis of said sleeve, said sleeve being subjected to permanent deformation by twisting according to a predetermined angle and directed in the sense of inclination of the slots;

a housing body, made of any suitable metal or metal alloy, and presenting a cavity apt to house in a stable manner the said elastic contact element, for its electric connection with any type of circuit.

According to a characteristic feature of the invention the sleeve, which constitutes the elastic element of the contact, is made of the metal or metal alloy which is required for its features of unaltered elasticity and electric conductivity also in presence of high changes of temperatures and repeated mechanical stresses, while the housing body is made of metal or metal alloy of the type normally used in components for electric conduction.

BRIEF DESCRIPTION OF THE DRAWINGS

The above and other features of the contact object of the present invention will appear better evident from the following description, made by way of non-limiting example, with reference to the figures of the attached drawings, in which.

DESCRIPTION OF THE PREFERRED EMBODIMENT

Figure 1:
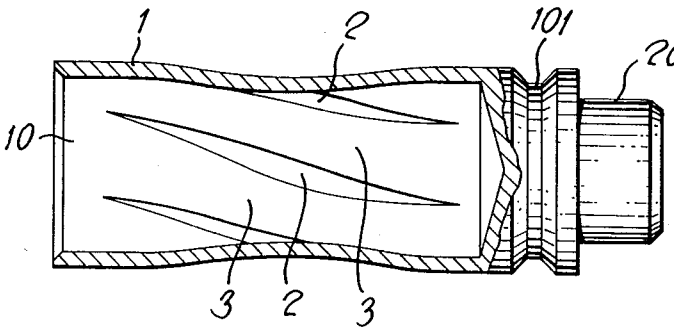
FIG. 1 is a side view, with parts in section, of the sleeve which constitutes the elastic element of the contact.

With reference to FIG. 1, there is shown the female contact element intended to be housed inside a suitable housing body. Said contact element consists of a rectangular circular cylindrical sleeve 1, closed at one end or base. According to what has been disclosed for example in the U.S. Pat. No. 4,447,108 in the name of the same inventor, on the cylindrical surface of the sleeve 1 there are obtained through slots 2, which are arranged equispaced along the whole circumference and inclined with respect to the longitudinal axis of sleeve 1, so as to define between each other the strips 3, which are also inclined of the same angle with respect to the longitudinal axis of the sleeve. By subjecting the sleeve provided with the slots to a twisting, that is by effecting a relative rotation according to a predetermined angle between the two end rings of the sleeve, a permanent deformation of same is obtained whereby the strips 3 tend to arrange themselves according to a family of straight generatrices of a hyperboloid of one branch. It is thus created at the interior of sleeve 1 a zone of restriction which constitutes the elastic contact surface for the pin contact 6 which will be inserted into the bore 10 of sleeve 1.

The sleeve 1 is provided at its rear end (with respect to the inlet opening for the pin contact) with an anular groove 101 and with a cylindrical plug 201 which is coaxial and integral with the said sleeve 1.

The sleeve 1 thus obtained is inserted inside a suitable housing body 4 which presents a cylindrical cavity 104, of a length substantially equal to the length of the sleeve 1 and of a diameter substantially equal or slightly greater than the maximum outer diameter of the sleeve itself. Said cavity 4 terminates with an annular step which defines a cylindrical section 204 having a diameter which is slightly smaller or substantially equal to the diameter of the cylindrical plug 201 of sleeve 1, in such a manner that in order to penetrate inside said cylindrical section 204 said plug 201 must be forced. The housing body 4 presents, always at its rear end, a hollow appendix 304 intended for the connection (in a known manner) of the terminal of an electric conductor (not shown). Obviously, the shape and size of said connection appendix 304 can vary in a known manner which is easily conceivable by a person skilled in the art, depending upon the required connection.

According to a feature of the invention, the sleeve 1, which constitutes the elastic element of the female contact is made of any suitable metal or metal alloy such as to maintain unaltered its features of elasticity and of electric conductivity in presence of high thermic changes and of repeated mechanical stresses deriving from the insertion and removal of the male pin contact effected several times. By way of non-limiting example it may be indicated a copper-beryllium alloy. The housing body 4 is instead preferably obtained of another metal or metal alloy which is conductive and plastically deformable, such as for example a brass alloy normally used in components for electric conduction.

Figure 2:
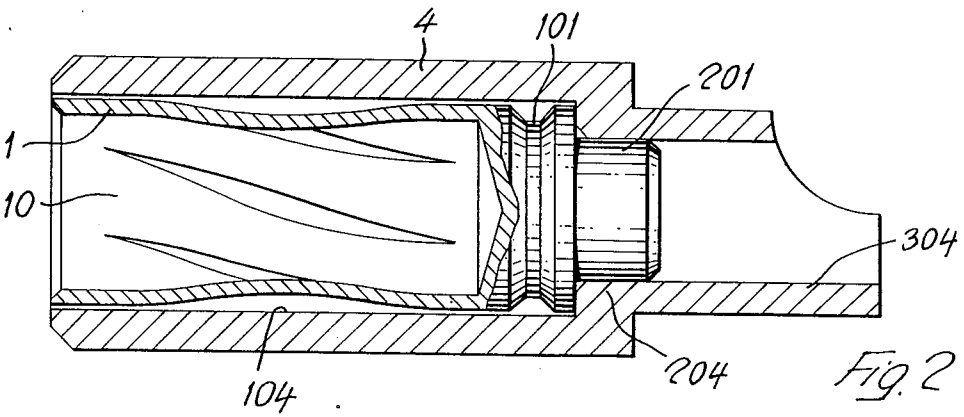
FIG. 2 is a lateral section with parts in view, of the composite contact, prior to the locking operation of the elastic element at the interior of the housing body.
Figure 3:
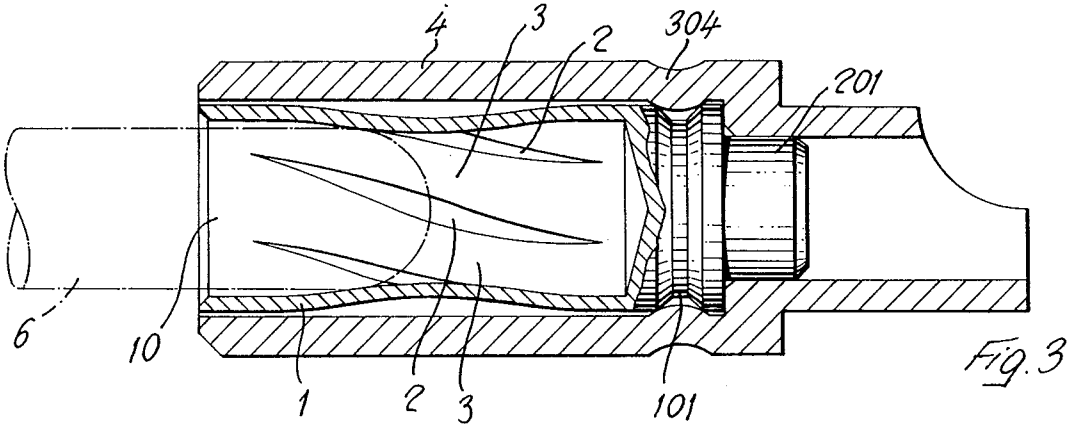
FIG. 3 is a view similar to that of FIG. 2, after the locking operation of the elastic element at the interior of the housing body.

As shown in FIG. 2, the sleeve 1 is inserted inside the cavity 104 of the housing body 4 and it is forced thereinto so as to ensure the full insertion of the cylindrical plug 201 inside the cylindrical section 204 in such a manne as to ensure a perfect electrical conductivity beween the two elements which constititute the contact, as well as a first mechanical the between the said elements. In order to permanently lock the sleeve 1 inside the housing body 4, the wall of the housing body itself is plastically deformed (as shown in FIG. 3) in correspondence of the annular groove 101 of the sleeve, for example by means of a punching or rolling operation, so as to obtain an inner thickening 304 (annular or by points) which penetrates at least partially inside the said groove 101, thus ensuring the locking of the sleeve 1 at the interior of the housing body 4.

Obviously the locking of the sleeve 1 at the interior of the housing body 4 can be obtained by any other suitable means or methods such as for example the electric spot welding.

Figure 4:
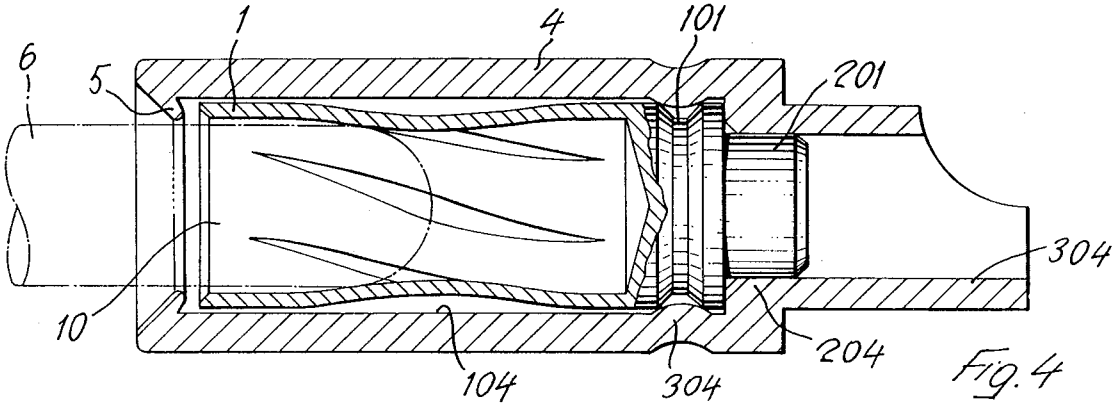
FIG. 4 is a view similar to that of FIG. 3, showing a constructive variation referred to the housing body.

In FIG. 4 there is shown as embodiment in which the housing body 4 (which has a tubular cylindrical shape) presents a length which is greater than the length of the sleeve 1 inserted inside its caivty, in order to consent to flange down, towards the interior, the forward edge of the said housing body, so as to obtain a frusto-conical edge 5, presenting a conicity directed towards the interior, which constitutes an inlet opening of the type required by some standrad rules relating to electrical connectors.

It is to be understood that the invention is not limited to the embodiments above described and shown by way of example and that several variations and modifications are possible, without however departing from the limits of the inventive idea as above described and claimed hereinafter.

I claim:

1. A composite female contact adapted to a receive a male contact of the pin type, in which, when the pin contact in not ionserted, the areas which establish electrical contact with the pin contact, upon insertion of same, are arranged at least approximately according to a family of straight generatrices of a hyperboloid of revolution of one branch, comprising:

an elastic contact element substantially in the form of a cylindrical sleeve made of a first suitable metal or metal alloy, said element having through slots arranged along its cylindrical surface and inclined with respect to the longitudinal axis of the said sleeve, said sleeve being permanently deformed by having been twisted a predetermined angle directed in the sense of inclination of the slots, a housing body, made of a second suitable metal or metal alloy having different physical properties than the said first metal or metal alloy, and presenting a cavity adapted to house said contact element in a stable manner for its electric connection with any type of circuit.

2. A composite female contact according to claim 1 wherein the cylindrical sleeve presents, at its rear end, at least one plug which is forceable into a corresponding cavity at the rear end of the cavity of the housing body.

3. A composite female contact according to claim 1 wherein the cylindrical sleeve is locked in the interior of the housing body by means of permanent plastic deformation of portions of the said housing body with respect to correspondingly shaped portions on the cylindrical sleeve.

4. A composite female contact according to claim 3 wherein the sleeve is provided at its rear end with an annular groove adapted to receive a portion of the inner wall of the cavity of the housing body.

* * * * *